US007108450B2

(12) United States Patent
Grubba

(10) Patent No.: US 7,108,450 B2
(45) Date of Patent: Sep. 19, 2006

(54) PORTABLE DRAG BOX WITH AUTOMATED SHEARING DEVICE

(75) Inventor: Bill Grubba, Terre Haute, IN (US)

(73) Assignee: SemMaterials, L.P., Tulsa, OK (US)

( * ) Notice: Subject to any disclaimer, the term of this patent is extended or adjusted under 35 U.S.C. 154(b) by 0 days.

(21) Appl. No.: 10/687,849

(22) Filed: Oct. 17, 2003

(65) Prior Publication Data

US 2005/0084330 A1 Apr. 21, 2005

(51) Int. Cl.
*E01C 23/07* (2006.01)

(52) U.S. Cl. ..... 404/84.5; 404/84.05; 404/84.1; 404/84.8; 404/92; 404/101; 404/108; 404/110; 404/115; 404/118

(58) Field of Classification Search ..... 404/84.1–84.5, 404/31, 102, 114, 84.05, 118, 84.8, 82, 101, 404/108, 110, 115, 92
See application file for complete search history.

(56) References Cited

U.S. PATENT DOCUMENTS 1,736,352 A * 11/1929 Mahoney et al. ..... 171/136
3,561,334 A * 2/1971 Gerosa et al. ..... 404/75
3,843,274 A 10/1974 Gutman et al.
4,014,525 A 3/1977 Oda et al.
4,708,516 A * 11/1987 Miller ..... 404/31
4,924,374 A * 5/1990 Middleton et al. ..... 700/57
5,000,615 A 3/1991 Murray
5,201,603 A 4/1993 Bassett et al.
5,201,604 A * 4/1993 Ferguson et al. ..... 404/110
5,258,961 A * 11/1993 Sehr et al. ..... 367/96
5,340,214 A 8/1994 Juzwiak
5,362,176 A * 11/1994 Sovik ..... 404/72
5,393,167 A 2/1995 Fujita et al.
5,460,649 A 10/1995 Strassman
5,512,093 A 4/1996 Huege et al.
5,588,776 A 12/1996 Swisher, Jr. et al.
5,653,552 A 8/1997 Wiley et al.
5,752,783 A 5/1998 Malone
6,027,282 A 2/2000 Horn
6,033,147 A * 3/2000 Richter ..... 404/79
6,036,353 A * 3/2000 Paetzold ..... 366/8

(Continued)

FOREIGN PATENT DOCUMENTS

WO WO 01/57320 A1 * 8/2001

OTHER PUBLICATIONS

Midland machinery Co., Inc. Mix Trailers; T-Series; http://www.midlandmachinery.com/mix-trailers.htm;2 pages; Dec. 17, 2001.

(Continued)

*Primary Examiner*—Raymond W. Addie
(74) *Attorney, Agent, or Firm*—Stinson Morrison Hecker LLP

(57) ABSTRACT

A drag box for use in applying cold mix asphalt paving material to a surface includes a pugmill for distributing the cold mix over the surface, a strike blade for shearing the asphalt mixture to a desired thickness, cylinders for raising and lowering the strike blade in response to elevational changes in the surface, at least one signal generator associated with each cylinder and adapted to produce a signal indicative of the elevation of the surface, and at least one signal receiver associated with each signal generator. The drag box is pulled behind a prime mover but preferably is not rigidly coupled with the prime mover. The blade is raised and lowered in response to signals emanating from the generator as the elevation of the surface changes, allowing surface level variations to be evened out while paving.

29 Claims, 3 Drawing Sheets

U.S. PATENT DOCUMENTS

| | | | | |
|---|---|---|---|---|
| 6,079,901 | A * | 6/2000 | Banks et al. | 404/108 |
| 6,227,761 | B1 | 5/2001 | Kieranen et al. | |
| 6,238,135 | B1 | 5/2001 | Rower | |
| 6,322,287 | B1 * | 11/2001 | Yelton | 404/118 |
| 6,398,453 | B1 * | 6/2002 | Stegemoeller | 404/108 |
| 6,530,721 | B1 | 3/2003 | Yost | |
| 6,554,080 | B1 * | 4/2003 | Horner | 172/785 |
| 6,672,797 | B1 * | 1/2004 | Zachman et al. | 404/84.5 |

OTHER PUBLICATIONS

Midland Machinery Co., Inc.; Manufacturing of Road Maintenance Equipment; http://www.midlandmachinery.com/nova-paver.htm; 6 pages; Dec. 17, 2001.

Midland Machinery Co., Inc.; ARRA New Technology Session; www/midlandmachinery.com/arra_new_technology_session.htm; 2 pages; Dec. 17, 2001.

Midland Machinery Co., Inc.; Mix-Paver® 800; http://www.midlandmachinery.com/mix-paver.htm; 2 pages; Dec. 17, 2001.

Midland Machinery Co., Inc.; http://www.midlandmachinery.com/Diag_B.htm; 1 page; Dec. 17, 2001.

Midland Machinery Co., Inc.; http://www.midlandmachinery.com/Diag_A.htm; 1 page; Dec. 17, 2001.

Aggregates & Roadbuilding; Canada's "Rock to Road" Magazine; Urban roads—a growing market for cold-in-place recycling; http://www.rocktoroad.com/urbanroads.htm; 5 pages; Dec. 17, 2001.

Asphalt Contractor; Bergkamp's M1 continuous Micro-surfacing paver; http://www.asphalt.com/HHIW/bergkamp.html; 2 pages; Dec. 17, 2001.

* cited by examiner

PORTABLE DRAG BOX WITH AUTOMATED SHEARING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a paving apparatus for applying asphalt mixtures to a surface. More specifically, the apparatus is a portable drag box that includes a pugmill and an adjustable strike blade. It is especially useful for applying cold mix.

While screeds are commonly used to smooth hot mix paving material as it is applied, cold mix paving material is typically too viscous for conventional screeds to properly smooth the applied material. The screeds tend to grab and pull the viscous mix as it is being applied.

Conventional adjustment mechanisms for screeds simply change the tilt or angle of attack of the screed but do not raise or lower the screed. Thus, in order to continue to lay a planar surface when the stiffness of the paving mixture increases, the forward speed of the screed must be slowed or the angle of attack of the screed must be adjusted. Even in doing either or both, the ride of the finished pavement is compromised.

Additionally, conventional screeds simply float on the applied pavement material. While the weight of the screed itself tends to cause the screed to float in a downward direction, the upward force induced by the applied pavement material tends to force the screed back upward. Thus, the screed tends to simply follow the contour of the roadway surface regardless of whether that surface is planar. Furthermore, conventional screeds are typically rigidly attached to a prime mover that pulls the screed across the paving material. Thus, vertical movement of the prime mover is transferred to the screed, which can cause unwanted elevational changes to be created in the paved surface.

Some screeds are manually adjusted in response to elevational changes in the surface. However, the lag time between the detection of a non-planar condition and the actual adjustment of the screed is too great with manual adjustment. Thus, the adjustment often actually exaggerates the detected non-planar condition by accounting for the non-planar condition of the surface only after the screed has passed that area. This creates more severe raised sections and indentations in the surface.

Similar to screeds, the strike blades of drag boxes are traditionally adjusted manually. Again, the lag time between the detection of a non-planar surface and the actual adjustment of the blade tends to create more severe raised sections and indentations in the surface. In addition, manual adjustment of the strike blade is costly as an additional operator must stand on the grate of the drag box to adjust the strike blade while other operators operate the prime mover that pulls the drag box. There is a need in the industry to lay a more planar road with a drag box.

In order to overcome these disadvantages, a device for evening out asphalt mixtures placed on a surface having high and low elevations is needed. More specifically, this device should be significantly more responsive to changes in the elevation of the surface than conventional devices.

SUMMARY OF THE INVENTION

According to the present invention, a portable drag box having a pugmill for use in laying asphalt mixtures on a surface is provided. This drag box is pulled behind a prime mover without being rigidly secured to the prime mover. The drag box further includes a strike blade for shearing the asphalt mixture to a desired thickness, cylinders for raising and lowering the strike blade in response to elevational changes in the surface being paved, and at least one signal generator associated with the cylinders. The signal generator is adapted to produce a signal indicative of the elevation of the surface. At least one signal receiver is associated with the signal generator and the cylinders. The receiver is operable to activate a proximity control device in response to a signal received from the signal generator. The strike blade is raised and lowered by the proximity control device in response to signals emanating from the signal generator as the elevation of the surface changes.

Other advantages and novel features of the invention will be set forth in part in the description which follows, and in part will become apparent to those skilled in the art upon examination of the following or may be learned from the practice of the invention.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF PREFERRED EMBODIMENT

Figure 1:
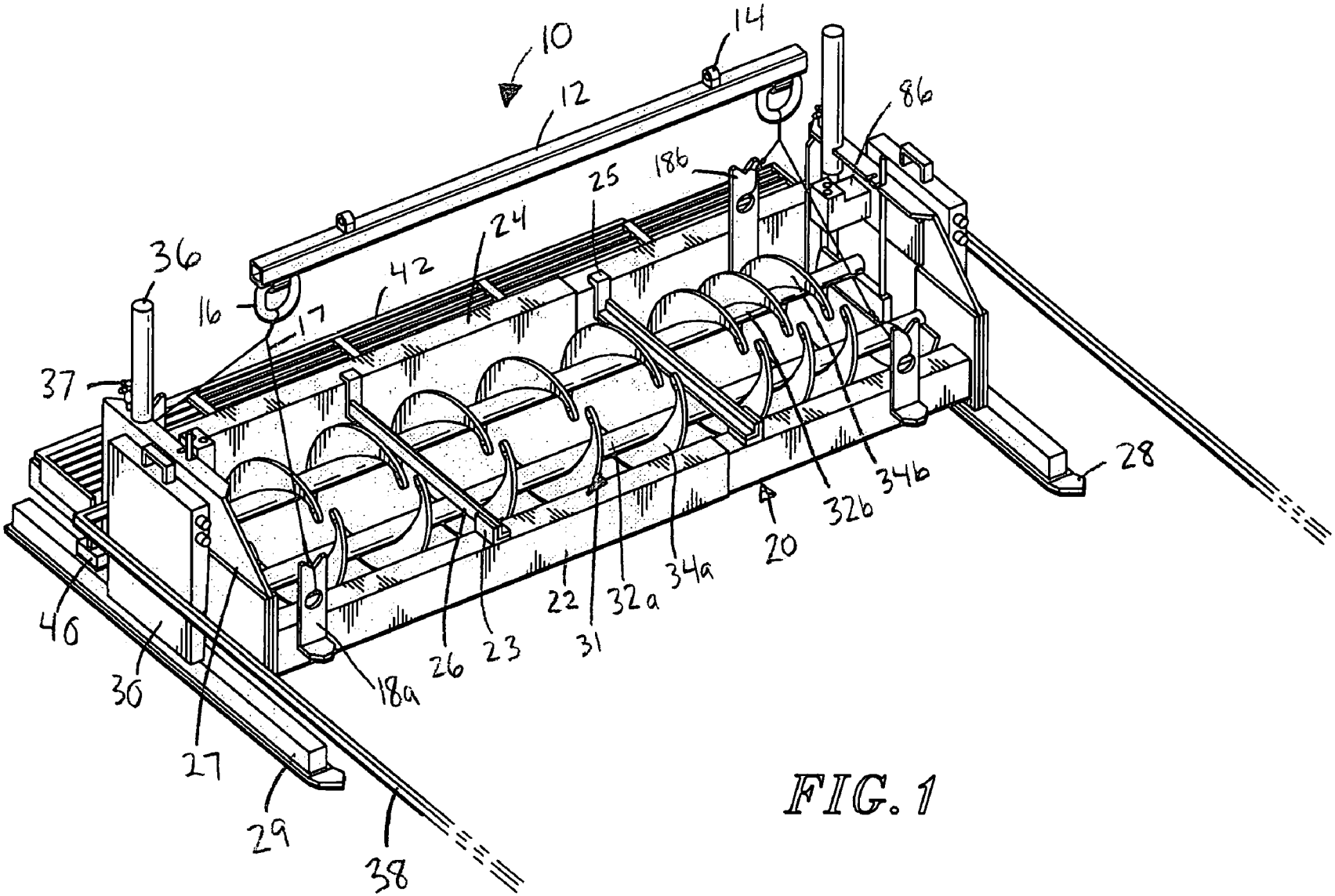
FIG. 1 is a perspective view of the drag box of the present invention.

Referring to FIG. 1, a portable drag box with pugmill for use in applying a paving material to a surface is broadly designated by reference numeral 10. Drag box 10 includes a pull-bar 12, with pull rings 14 located on the upper edge of pull bar 12 and attach rings 16 on the lower edge of pull bar 12. Cables 17 couple attach rings 16 to tie points 18*a*, 18*b* on a frame 20 of drag box 10. Frame 20 includes a front bar 22, a rear bar 24, and confinement ends 27. Cross bars 26 extend between front bar 22 and rear bar 24 and provide rigidity to frame 20. Cross bars 26 are secured to front bar 22 via brace 23 and to rear bar 24 via brace 25. The frame 20 is coupled with and rides on skis 28 via its confinement ends 27. Gear boxes 30 are also coupled with skis 28 and confinement ends 27. Skis 28 provide support for gear boxes 30 via support blocks 29. A pugmill is broadly designated by reference numeral 31. It includes two shafts 32*a*, 32*b* that extend between gear boxes 30. It further includes augers 34*a*, 34*b* that are coupled around shafts 32*a*, 32*b*. Hydraulic cylinders 36 are coupled with confinement ends 27. Manual adjustment mechanisms 37 are also coupled with confinement ends 27. Brackets 38 are coupled with confinement ends 27 and extend from drag box 10. They are adapted to be attached to a prime mover. A grate 42 extends along the rear of drag box 10 to provide a standing platform for operators and to protect and shield the blade area of drag box 10.

Signal boxes 40 are mounted to brackets 38, and each include one or more sensors therein. Each sensor includes a transmitter for sending signals to the surface being paved and a receiver for receiving responsive signals from the surface being paved. Preferably, signal boxes 40 have open bottoms, and each contain multiple sensors therein.

Figure 2:
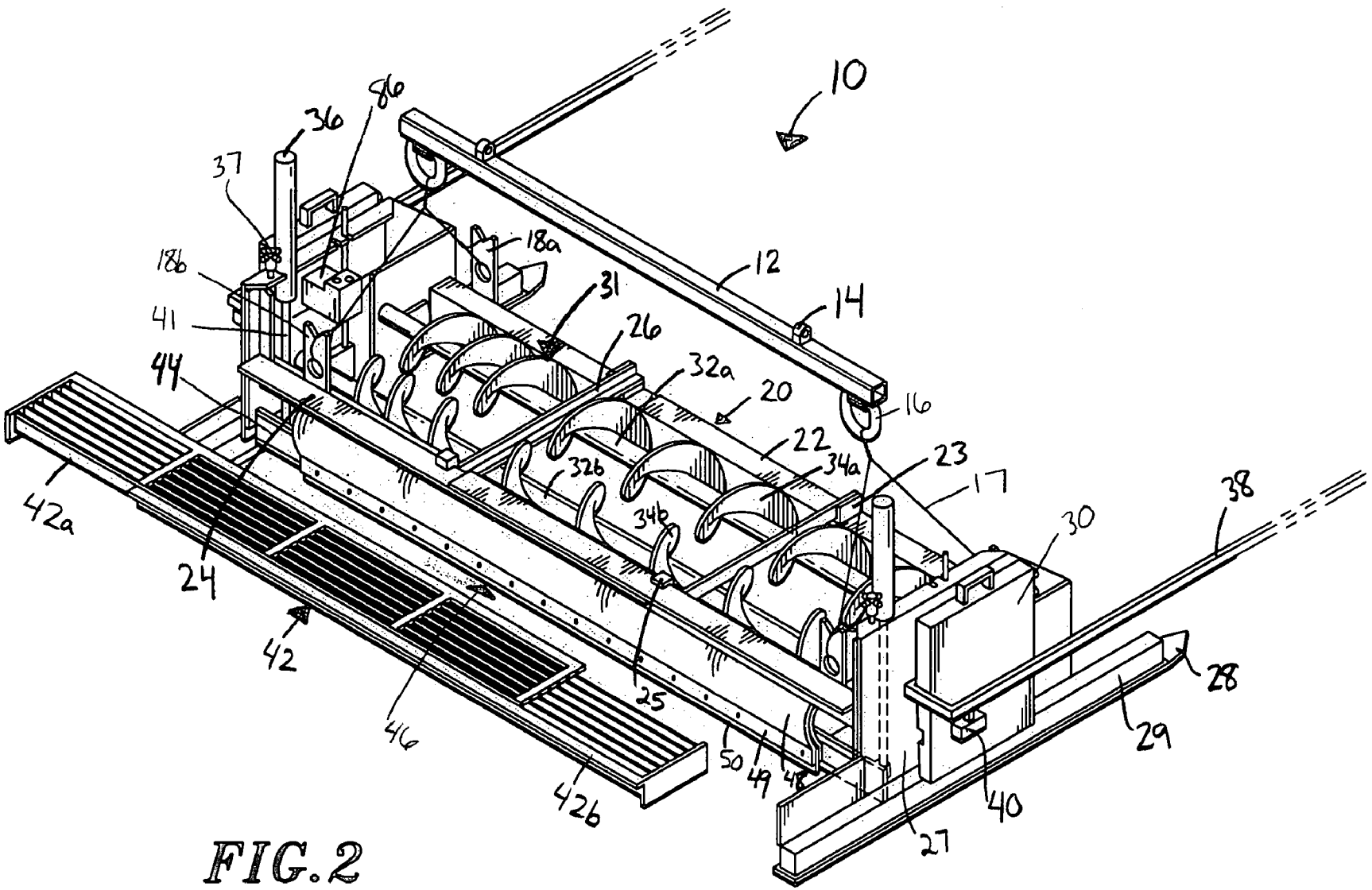
FIG. 2 is a partially exploded, perspective view of the apparatus of FIG. 1 showing the strike blade of the apparatus.

As best seen in FIG. 2, the housings of hydraulic cylinders 36 are coupled with frame confinement ends 27. Movable rods 41 extend from cylinders 36. The ends of the movable rods 41 are coupled with a blade carrier 44. A blade 46 is attached to blade carrier 44. Blade 46 includes a contour plate 48, a strike blade 49, and a wear strike 50. Strike blade 49 forms a vice around wear strike 50 to hold it in place. Hydraulic cylinders 36 raise or lower blade carrier 44 and thus blade 46 in response to signals received by sensors within signal box 40.

Referring again to FIG. 1, front and rear frames 22, 24, shafts 32*a*, 32*b*, augers 34*a*, 34*b*, and grate 42 are telescopic and can be extended in a direction substantially perpendicular to the direction of travel of the apparatus so as to adapt drag box 10 to varying widths of surfaces. The telescopic properties of grate 42 are shown in FIG. 2 and are represented as 42*a* and 42*b*. In the extended position, drag box 10 can distribute and level more asphalt mixture in a single pass.

Figure 3:
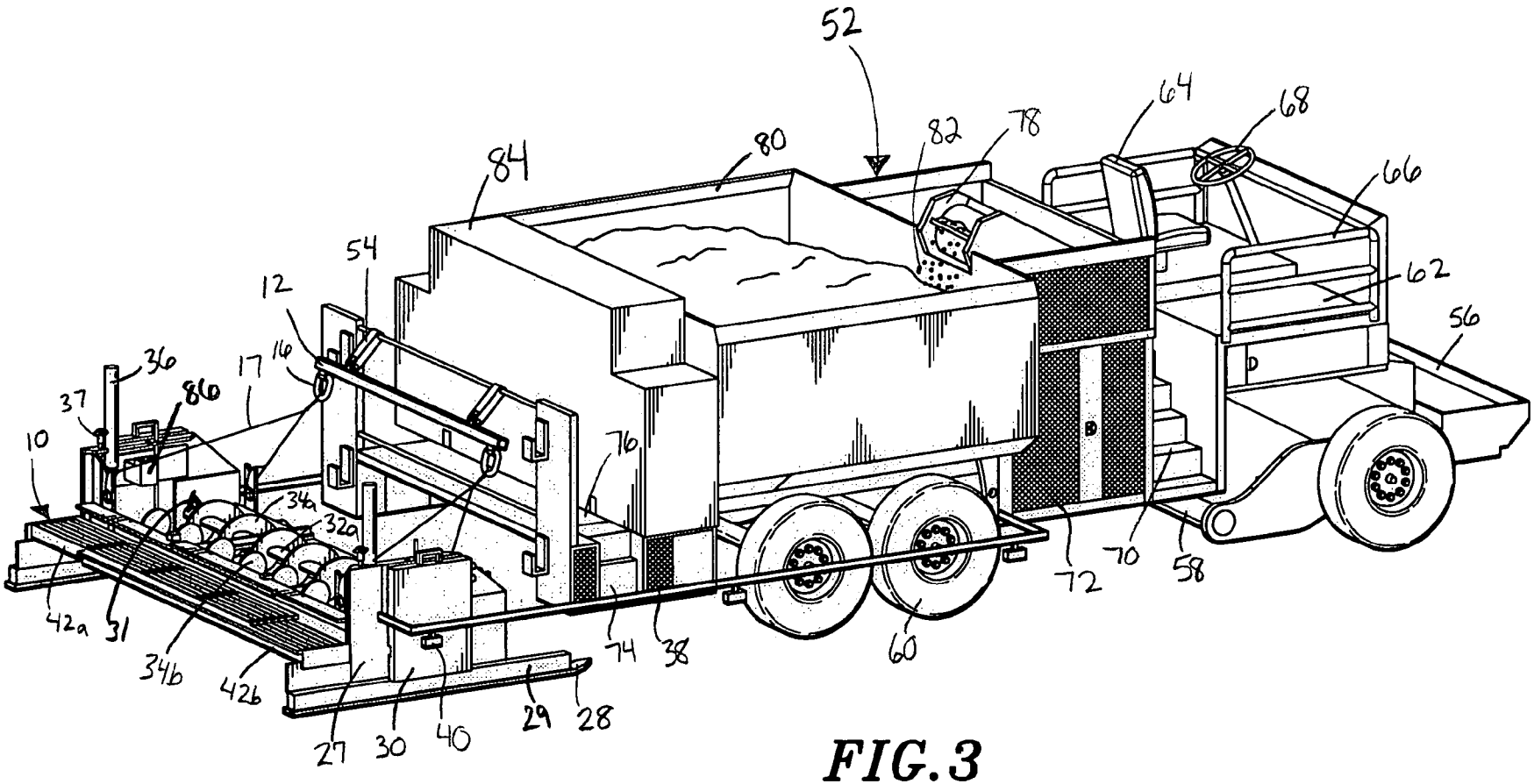
FIG. 3 is a perspective view of a prime mover pulling the drag box of FIG. 1.

In FIG. 3, a prime mover 52 is shown pulling drag box 10. Ties 54 couple prime mover 52 to pull-bars 12 of drag box 10. Prime mover 52 includes a bin 56 for receiving aggregate, which is located at the front of the vehicle. Bin 56 is coupled with a chassis 58 of the prime mover 52. Wheels 60 are also coupled with chassis 58. A platform 62, which supports a seat 64 and railing 66, is supported by chassis 58 of prime mover 52. A steering wheel 68 is coupled with wheels 60, allowing a driver sitting in seat 64 to control the direction of prime mover 54. Stairs 70, which are also supported by chassis 58, lead to platform 62. The engine (not shown) of prime mover 54 is located behind access panels 72. Prime mover 54 has a second set of stairs 74 leading to a back platform 76. Back platform 76 allows a second operator to access further controls for moving the prime mover 54 and the drag box being pulled.

An aggregate conveyor 78 transfers aggregate from bin 56 to a second bin 80. Aggregate 82 is shown entering bin 80. A fines feed bin 84 is coupled to the back of bin 80. The emulsion/water tank on the prime mover 52 is not shown. The aggregate and emulsion are mixed together, and fines feed, such as cement and/or lime, from bin 84 may be added to the mixture before it is distributed on the ground. The asphalt mixture is distributed from prime mover 52 onto the surface in front of the drag box 10.

Preferably, drag box 10 includes more than one signal box 40 on each bracket 38. For example, as shown in FIG. 3, three signal boxes 40 are located on each side of drag box 10, attached to brackets 38. Furthermore, preferably, each signal box 40 includes a plurality of sensors therein, which generate and receive signals. Most preferably, at least about five sonar sensors are within each box. Box 40 has an open bottom allowing signals from sensors to be broadcast to detect the elevation of the surface. The reflected signal from the surface is received by the sensors and processed to determine the height of the surface. A control mechanism 86 coupled to hydraulic cylinders 36 moves the cylinder rods 41 and thus strike blade 46 in response to the processed signals.

Preferably, the sonar sensors span no more than about 12 feet in a given direction of travel. Still further, each of the sonar sensors should be within about 2 feet of the sides of the drag box 10. Preferably, any signals that are averaged with each other should be within about 14 inches per unit and any signals averaged between units should be within 25 feet of each other. The signals may be compared to a fixed baseline.

The asphalt mixture being distributed by the drag box of the present invention may include, but is not limited to, cold mix, hot mix, recycled asphalt pavement (RAP) mix, slurry seal, or microsurfacing mix. It is desirable to process cold mix with the equipment of the present invention, as it is sufficiently durable to distribute and smoothen cold mix. The asphalt mixture may consist of merely asphalt and aggregate or preferably additives are added to the asphalt in forming the asphalt mixture.

Any distribution device may be used in place of pugmill 31. The distribution device may include, but is not limited to, a slurry box, a screw conveyor, a microsurfacing box, a paddle mixer, or diffusion flights. Preferably, in addition to distributing asphalt mixture, the distribution device also mixes the asphalt mixture before and/or while distributing it.

Any shearing device may be used in place of blade 46. The shear device may include, but is not limited to, devices having less surface area in contact with the ground than a screed and capable of shearing an asphalt mixture. Preferably, the shearing device is a blade and is concave with respect to the direction of travel of the vehicle. Any proximity control device may be used in place of hydraulic cylinders 36. For instance, a motorized pulley system may be the proximity control device. Preferably, the proximity control device includes 2 hydraulic bi-directional cylinders.

A paving mixture is applied at a thickness of about ⅜ of an inch to 4 inches. The apparatus of the present invention is especially useful when asphalt mixtures are applied at a thickness of about 1 to 4 inches. The apparatus of the present invention is significantly more useful than conventional devices when asphalt mixtures are applied at a thickness of about 2 to 4 inches. The shearing device may be at about a 60° to 120° angle with respect the surface being paved. Preferably, the shearing device is angled while shearing the paving material so that the paving material slopes downward to a surface's edge for drainage purposes. Preferably, the shearing device is a blade and is concave with respect to the direction of travel of the apparatus. The shearing device should be within 6 inches of the nearest auger. Preferably, it is within 3 inches of the nearest auger. Most preferably, the nearest auger is within 1 inch of the shearing device.

In operation, asphalt mixture is deposited from bin 80 of prime mover 52 onto a surface in front of drag box 10. Alternatively, aggregate and binder may be deposited unmixed or not fully mixed. As drag box 10 is pulled on skis 28 by prime mover 52 into the deposited mixture, augers 34 distribute asphalt perpendicular to the direction of travel. Augers may also function to mix aggregate and binder into the asphalt mixture and then distribute it. Preferably, augers 34*a* and 34*b* rotate in opposite directions of one another. This balances the material in the box and keeps it moving. Skis 28 and confinement ends 27 contain the asphalt mixture within the confines of drag box 10 and substantially prevent it from being pushed beyond the confines of the drag box 10. Because drag box 10 is not rigidly coupled with prime mover 52, drag box 10 floats on skis 28 along the surface independent of the height of prime mover 52. As prime mover 52 is moving forward, sensors within signal boxes 40 send signals to the surface to measure its elevation. Preferably, there are signal boxes 40 on both brackets 38 so that the center of a roadway surface and the edge of the roadway surface are measured. Preferably, there are multiple sensor boxes on side of drag box 10 so that upcoming changes in the surface can be measured and so that these measurements can be averaged so as to gradually slope any inclines. The signals received from the signal boxes are transmitted to a signal receiver, where the multiple signals are averaged. They may be weight averaged if desired. The receiver then sends a signal to control mechanism 86 that controls hydraulic cylinders 36. Thus, hydraulic cylinders 36 will adjust blade 46 directly in response to elevations in the surface being paved so as to create a more planar surface. The device of the present invention has a dampening effect on elevational variations in a surface. Unlike screeds, which are rigidly coupled to the prime mover, blade 46 is in suspension at all times. The prime mover pulling the drag box of the present invention can thus be stopped and started without causing the drag box to create indentations in the surface being paved.

The receiver controls the height and slope of the blade, based on the elevation of the ground as determined by the sensors. The blade is instantaneously and proportionally raised or lowered in response to the elevation of the surface being paved. Occasionally, the operator may want to stop the generation of signals so that the blade may be controlled in a manual mode. Manual adjustment mechanisms 37 may then be used to raise and lower the blade. Typically, signals are stopped and the blade is adjusted manually when the prime mover is started and stopped. However, it is contemplated by the present invention to keep the signal generators and proximity control device of the blade operating while the prime mover is started and stopped.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

I claim:

1. A drag box for placing an asphalt mixture on a surface, said drag box adapted to be coupled with a prime mover for pulling said drag box over said surface, said drag box comprising:

a framework adapted to be pulled behind said prime mover, said framework adapted to be coupled with said prime mover to accommodate floating vertical movement independent of said prime mover;

a non-rigid connecting structure coupled with said framework for coupling said framework with said prime mover;

a device coupled with said framework for distributing said asphalt mixture over said surface;

a blade capable of shearing asphalt mounted on said framework for forming a substantially planar asphalt surface after said asphalt mixture has been distributed over said surface, said blade being moveable in a vertical plane independent of said prime mover;

a proximity control device mounted on said framework and coupled with said blade for raising and lowering said blade in response to elevational changes in said surface;

at least one signal generator associated with said proximity control device for producing a signal indicative of the elevation of said surface; and at least one signal receiver associated with said proximity control device for activating said proximity control device in response to a signal emanating from said signal generator.

2. The drag box of claim 1, further comprising:

a prime mover for dispensing said asphalt mixture that is coupled with said drag box by said non-rigid connecting structure and pulls said drag box.

3. The drag box of claim 1, wherein said proximity control device comprises a cylinder for raising and lowering said blade.

4. The drag box of claim 1, wherein said signal generator is a sonar generator and said signal receiver is a sonar receiver.

5. The drag box of claim 1, wherein said blade is concave with respect to the direction of travel of said drag box.

6. The drag box of claim 1, wherein said blade is able to be proportionally raised or lowered in response to elevational changes in said surface.

7. The drag box of claim 1, wherein said receiver sends a signal to control the height and slope of said blade.

8. The drag box of claim 1, wherein said blade is able to be extended in a direction that is substantially perpendicular to the direction of travel of said apparatus.

9. The apparatus of claim 1, wherein said distribution device is a pugmill.

10. The apparatus of claim 1, wherein said distribution device comprises two augers that rotate in opposite directions from one another.

11. The drag box of claim 1, further comprising:

confinement ends coupled with said distribution device for containing said asphalt mixture within said apparatus.

12. The drag box of claim 11, wherein said confinement ends comprise skis.

13. The drag box of claim 11, wherein said signal generators are coupled with said confinement ends such that at least one generator is coupled with a first end and at least one generator is coupled with a second end.

14. The drag box of claim 1, wherein said apparatus includes a plurality of signal generators and a plurality of signal receivers associated therewith.

15. The drag box of claim apparatus of claim 14, wherein said plurality of signals received by said signal receivers are averaged.

16. The drag box of claim 1, wherein said drag box is able to distribute and shear asphalt mixtures that are about ⅜ of an inch to 4 inches in thickness.

17. The drag box of claim 16, wherein said drag box is able to distribute and shear asphalt mixtures that are about 1 to 4 inches thick.

18. The apparatus of claim 1, wherein said distribution device comprises at least one auger.

19. The drag box of claim 18, wherein the distance between said blade and said auger is no more than about one inch.

20. The drag box of claim 18, wherein said auger is within 6 inches of said blade.

21. A method of leveling a surface using a drag box comprised of a framework adapted to be coupled with a prime mover, a non-rigid connecting structure coupled with said framework for coupling said framework with said prime mover, a distribution device coupled with said framework, a blade mounted on said framework, and a proximity control device mounted on said framework and coupled with said blade for raising and lowering said blade in a vertical plane independent of said prime mover, said method comprising:

pulling said drag box in a direction of travel;

applying an asphalt mixture to said surface while said drag box is moving;

adjusting the height of said blade with said proximity control device so that it is raised and lowered substantially instantaneously as the elevation of said surface changes; and leveling said asphalt mixture using said blade, wherein steps (a)–(d) are accomplished in a single pass.

22. The method of claim 21, wherein said drag box further comprises a signal generator and a signal receiver associated with said proximity control device, said method further comprising:

measuring the elevation of said surface using a signal from said signal generator as said apparatus moves in said direction of travel; and processing said signal using a signal receiver.

23. The method of claim 22, further comprising:

measuring the altitude of said surface using a signal from said signal generator.

24. The method of claim 21, wherein said asphalt mixture is substantially diluent-free.

25. The method of claim 21, wherein said surface is dirt, gravel, asphalt, or combinations thereof.

26. The method of claim 21, further comprising:

distributing said asphalt mixture with said distribution device.

27. The method of claim 21, wherein said distribution device comprises at least one auger.

28. The method of claim 21, further comprising:

stopping said drag box from moving in said direction of travel; and moving said drag box in said direction of travel, wherein substantially planar movement of said blade is maintained during said stopping and moving steps.

29. The method of claim 28, further comprising:

manually controlling said blade while said drag box is stopped.

* * * * *